US007988145B2

(12) United States Patent
Valenti, Jr. et al.

(10) Patent No.: US 7,988,145 B2
(45) Date of Patent: Aug. 2, 2011

(54) HOLD-DOWN DEVICE FOR MULTIPLE-PLY OR INTEGRATED FORMS IN PRINTER TRAYS

(75) Inventors: F. Paul Valenti, Jr., Barrington, IL (US); Carl Opel, Carol Stream, IL (US); Dan Hedger, Grayslake, IL (US); Tom Hogan, Trevor, WI (US)

(73) Assignee: Chicago, Tag & Label, Libertyville, IL (US)

( * ) Notice: Subject to any disclaimer, the term of this patent is extended or adjusted under 35 U.S.C. 154(b) by 253 days.

(21) Appl. No.: 12/468,529

(22) Filed: May 19, 2009

(65) Prior Publication Data

US 2010/0296853 A1 Nov. 25, 2010

(51) Int. Cl.
*B65H 1/00* (2006.01)

(52) U.S. Cl. ..... 271/145; 399/393

(58) Field of Classification Search ..... 271/145; 399/393

See application file for complete search history.

(56) References Cited

U.S. PATENT DOCUMENTS

| | | | | |
|---|---|---|---|---|
| 4,060,236 | A | 11/1977 | Carstedt | |
| 4,068,839 | A | 1/1978 | Bullock et al. | |
| 5,066,984 | A | 11/1991 | Coombs | |
| 5,100,039 | A | 3/1992 | Kingston | |
| 5,260,759 | A | 11/1993 | Kobayashi | |
| 5,284,337 | A * | 2/1994 | Ettischer et al. | 271/220 |
| 5,346,457 | A | 9/1994 | Kimura | |
| 5,555,083 | A | 9/1996 | Kuo et al. | |
| 5,640,664 | A * | 6/1997 | Ukei et al. | 399/393 |
| 5,808,647 | A | 9/1998 | Kurata et al. | |
| 5,947,467 | A | 9/1999 | Billings et al. | |
| 6,064,853 | A | 5/2000 | Embry et al. | |
| 6,065,747 | A | 5/2000 | Khovaylo et al. | |
| 6,139,008 | A | 10/2000 | Margiotta | |
| 6,196,542 | B1 | 3/2001 | Allmendinger | |
| 6,227,536 | B1 | 5/2001 | Bethke | |
| 6,328,492 | B1 | 12/2001 | McKay et al. | |
| 6,698,750 | B1 | 3/2004 | Moser | |

(Continued)

FOREIGN PATENT DOCUMENTS

| | | |
|---|---|---|
| EP | 0 469 534 B1 | 5/1996 |
| EP | 0 530 777 B1 | 4/1997 |

*Primary Examiner* — David H Bollinger

(74) *Attorney, Agent, or Firm* — Miller, Matthias & Hull LLP

(57) ABSTRACT

A hold-down device is disclosed for holding down the leading edges of sheet materials, such as multiple-ply sheets or integrated forms, disposed in a tray of a printer in a horizontal or flat position prior to feeding the leading edge of the top sheet or integrated form into the printer feed mechanism. Because some sheet materials are prone to curling, which causes jamming in the feed mechanism or downstream in printing path within commonly used printers, the disclosed hold-down device maintains the leading edge of the top sheet in a flat or horizontal position so it can be reliably and evenly received in the feeder mechanism of the printer, thereby reducing the chances of jamming when sheet materials that are prone to curling, such as multiple-ply sheets or integrated forms, are being printed. The hold-down device includes a base with two ends. Each end may include a retainer or other means for detachably connecting the base to the paper tray of the printer. The base is hingedly connected to a pair of parallel arms. Each arm includes a distal end that engages or rests on the top sheet adjacent, but proximal to the leading edge of the top sheet to prevent curling.

20 Claims, 6 Drawing Sheets

U.S. PATENT DOCUMENTS

| | | | | |
|---|---|---|---|---|
| 7,029,003 | B2 * | 4/2006 | Takeda et al. | 271/113 |
| 2005/0140714 | A1 | 6/2005 | Silverbrook et al. | |
| 2005/0156370 | A1 | 7/2005 | Lang et al. | |
| 2006/0012110 | A1 * | 1/2006 | Yamamoto et al. | 271/145 |
| 2006/0244199 | A1 | 11/2006 | Marasco | |
| 2007/0126172 | A1 * | 6/2007 | Nakamura et al. | 271/145 |
| 2008/0224383 | A1 | 9/2008 | Feygelman | |

* cited by examiner

HOLD-DOWN DEVICE FOR MULTIPLE-PLY OR INTEGRATED FORMS IN PRINTER TRAYS

BACKGROUND

1. Technical Field

An accessory for a printer tray is disclosed. More specifically, a device is disclosed for holding the top sheets of a stack in a flat position in a printer tray when the sheet material is prone to curling as a result of changes in humidity, temperature, age, etc. The disclosed hold-down device prevents such curling at the leading edge and subsequent jamming of the feed mechanism of a printer as a result of the curling. While the disclosed accessory is particularly useful for multiple-ply or integrated forms, which are particularly prone to curling, the disclosed accessory can be used with all types of sheet material, including single ply sheets or stock.

2. Description of the Related Art

A laser printer is a common type of computer printer that rapidly produces high quality text and graphics on plain paper as well as multiple-ply forms or integrated forms. As with digital photocopiers and multifunction printers (MFPs), laser printers employ a xerographic printing process but differ from analog photocopiers in that the image is produced by the direct scanning of a laser beam across the photoreceptor of the printer.

Laser printers have many significant advantages over other types of printers. Unlike impact printers, laser printer speed can vary widely, and depending upon the graphic intensity and other factors. Fast laser printers can print over 200 monochrome pages per minute (12,000 pages per hour). Fast color laser printers can print over 100 pages per minute (6000 pages per hour). High-speed laser printers are used for mass mailings of personalized documents, such as credit card or utility bills, and are competing with lithography in some commercial applications.

Laser printers are also being used to print multiple-ply forms and integrated forms that may include both shipping information and a return mailing label on a single top sheet. Such multiple-ply forms include a backing sheet, a layer of adhesive and a top printed sheet which may include perforations or slits for removing certain parts of a form, such as a return mailing label from the remaining portions of the top sheet, such as the original shipping information.

Inkjet printers come in many different types and sizes they are mostly used as desktop printers and most of them are able to print in color. Inkjet printers are generally cheaper to buy than laser printers, however they are more expensive to maintain. Cartridges need to be changed more frequently and special paper may be needed to produce a good quality image. Most inkjet printers work by spraying small ink onto paper through tiny nozzles. Spraying is initiated by heating the ink to create a bubble until the pressure forces it to burst and hit the paper. Then the nozzle is closed and the process repeated thousands of times per second. Inkjet printers can also be used to print multiple-ply forms and integrated forms that may include shipping information and a return mailing label.

Although the inkjet and laser printers have replaced most dot matrix printers, many companies still own dot matrix printers for forms. Dot matrix printers are impact printers; they create images by striking an inked ribbon onto a paper using pins and make more noise and provide lower resolution than laser and inkjet printers. While not as popular as laser printers, dot matrix printers can be used to print multiple-ply forms an integrated forms.

Most inkjet and laser printers have a paper tray for holding a stack of paper or, in the case of the present disclosure, a stack of multiple-ply or integrated forms. Most printers also include single-sheet feeders or feed trays. The mechanism that draws a sheet or form into the printer and towards the printing path is often referred to as the "feed mechanism." A typical printer feed mechanism includes multiple pairs of laterally spaced-apart opposing rollers that are used to pull the top sheet or form in from the tray or feeder and advance the sheet towards the printing area.

A common problem associated with all types of printers that rely upon sets of rollers to pull single sheets from a stack of sheets is the phenomenon known as "jamming." Specifically, one lateral portion of a leading edge of a sheet may fit neatly between a pair of opposing rollers while an opposite lateral portion of the leading edge of the sheet engages the upper or lower roller of another pair of rollers causing part of the sheet to be pulled inside the printer and the other portion of the sheet to be crumpled against the rollers. Further, as pairs of rollers and belts are used to pull a sheet through the tortuous printing path, jamming can occur downstream along the printing path within the printer as well.

The jamming problem is particularly problematic when printing multiple-ply sheets or integrated forms that include a backing or release layer, an adhesive layer and a label layer attached to the backing layer by the adhesive layer. The materials used for the backing layer and the label layer are different. Backing or release layers are typically thin sheets of waxed or silicon-coated paper while the label layers are fabricated from thicker sheets of paper and carry a layer of adhesive. As a result, the backing and label layers absorb water or are affected by humidity differently. The backing and label layers may also react to temperature changes or other environmental changes differently. Further, the backing and label layers may also deteriorate or age differently. As a result, multiple-ply integrated forms or labels are prone to curl in response to various environmental changes. When the integrated forms are placed in a tray of the laser printer or an inkjet printer, such curling can cause jamming at the initial feed mechanism or downstream in the printing path. The jamming of the printer causes frustration to the user and may also require professional maintenance to repair the printer. In addition to multiple-ply or integrated forms, environmental conditions can cause other forms of sheet material to curl, including single-ply sheets and certain types of paper stock.

As a result, there is a need for an improved device for supplying sheet materials to printer feed mechanisms that will reduce the incidence of jamming associated with multiple-ply labels, integrated forms and other sheet materials prone to curling.

SUMMARY OF THE DISCLOSURE

As a solution to the above-described jamming problem caused by curling of the leading edges of sheet materials, a hold-down device is disclosed for holding the leading edges of sheets disposed in a tray of a printer in a flat or horizontal position prior to entering the feed mechanism of the printer. As a result, the top sheet can be reliably fed into the printer because the leading edge of the top sheet is flat or horizontal and not curled.

The disclosed hold-down device includes a base. The base is hingedly connected to at least one arm. The arm includes a proximal end and a distal end. The distal end of the arm engages the top sheet adjacent to, but proximal or short of the leading edge of the top sheet so the distal end of the arm does not interfere with the feed mechanism of the printer. The distal end of the arm insures that the leading edge of the top sheet is flat as it is received by the feed mechanism of the printer.

In a refinement, the hold-down device includes a pair of parallel arms hingedly connected to the base with distal ends each engaging the top sheet adjacent, but proximal to or short of the leading edge of the top sheet.

In a refinement, the base is disposed opposite the rear edges of the sheets from the leading edges of the sheets.

In a refinement, the base further includes at least one retainer for detachably connecting the base to the tray. In a further refinement of this concept, base includes two ends with each end including a retainer for detachably connecting the base to the tray.

In another refinement, the base is disposed parallel to one of the side edges of the sheets. The base is perpendicularly connected to a rear strip, which, in turn, is hingedly connected to the at least one arm. In a further refinement of this concept, the hold-down device includes a pair of parallel arms hingedly connected to the rear strip and with distal ends each engaging the top sheet adjacent, but proximal to the leading edge of the top sheet. The rear strip may include one or more retainers for detachably connecting the base to the tray.

An improved paper tray assembly for a printer is also disclosed. The disclosed paper tray assembly includes a tray with a front wall, a rear wall and a pair of sidewalls extending therebetween. The tray also includes a bottom for supporting a stack of sheets. The tray further includes an adjustable rear brace that can be moved into engagement with the rear edges of the stack of sheets and at least one adjustable side brace that can be moved into engagement with one of the side edges of the stack of sheets. The paper tray assembly also includes a hold-down device for holding the leading edges of the sheets disposed in the tray in a horizontal position prior to feeding a top sheet into the printer. The hold-down device, as described above, includes a base hingedly connected to at least one arm with a distal end that engages the top sheet adjacent to, but proximal or short of the leading edge of the top sheet.

Because the arms are detachably connected to a base or rear strip, the arms can be changed and arms of different lengths can be used, depending upon the particular application, the particular paper tray and/or the particular forms being printed.

The disclosed hold-down device may be used with multiple-ply or integrated forms that are prone to curling in many environments, and may be used permanently in a printer tray for all types of sheet material. This disclosure is not limited to the printing of multiple-ply or integrated forms. Multiple-ply or integrated forms are specifically mentioned because they present specific examples of sheet materials that are prone to curling.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
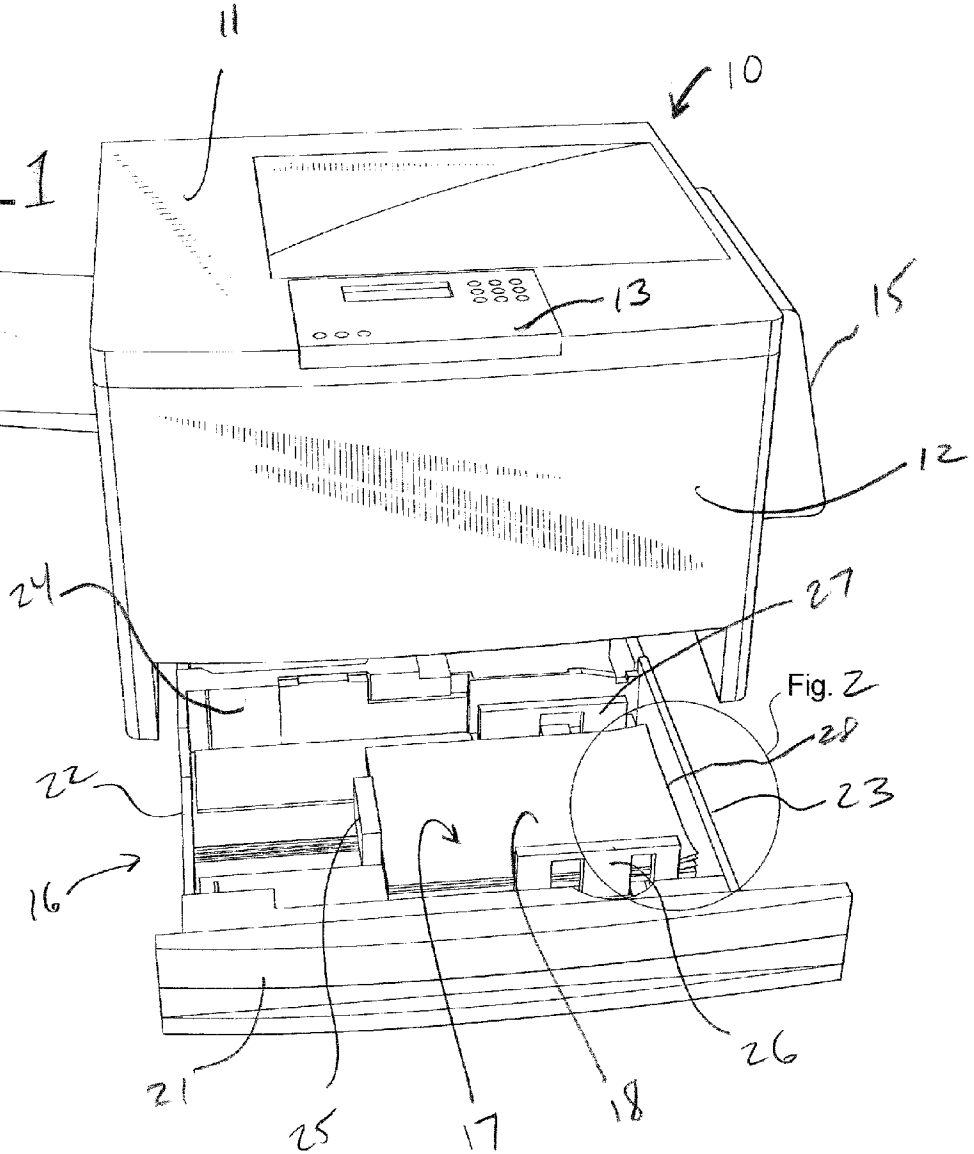
FIG. 1 is a perspective view of a printer and paper tray that can be used with the hold-down device disclosed herein, and also particularly illustrating curled leading edges of the sheets disposed in the tray.

FIG. 1 illustrates a printer 10 with a top or cover assembly 11, a side panel 12, a display panel 13 and a separate sheet feeder 14. A toner cartridge panel or cover is shown at 15. Typically, the printer 10 also includes a paper tray assembly 16, which is shown in a pulled-out position and loaded with a stack 17 of individual sheets or forms, the top sheet or form being indicated at 18.

The paper tray assembly 16 typically includes the door or sidewall 21, a rear wall 22, a front wall 23 and the sidewall 24. The front wall 23 is disposed closest to the feed mechanism (not shown) which can vary from printer to printer. To accommodate stacks of sheets 17 of varying sizes, paper tray assemblies 16 also include slidable braces such as the slidable or adjustable rear brace 25 and the slidable or adjustable side braces 26, 27.

Figure 2:
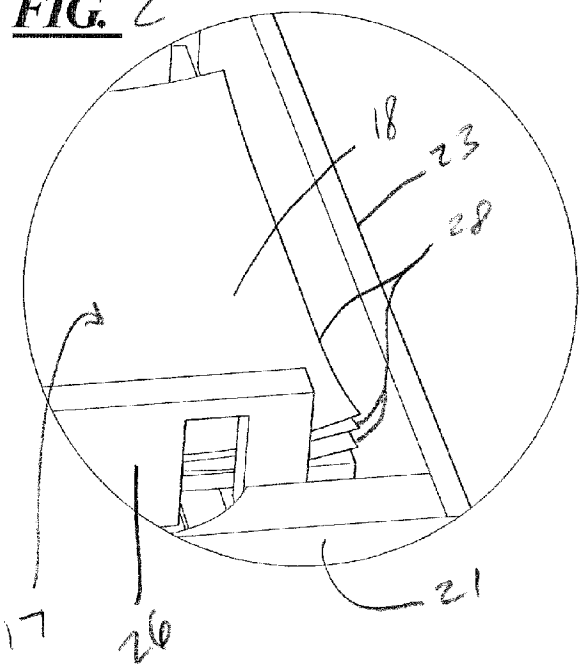
FIG. 2 is an enlarged partial view of the stack of sheets with curled leading edges and a portion of the paper tray and side brace of the paper tray illustrated in FIG. 1.

Turning to FIG. 2, a specific problem exists when multiple-ply sheets such as labels or integrated forms are used in laser printers like the one shown at 10 or inkjet or dot matrix printers that include feed mechanisms for removing one sheet 18 at a time from a stack of sheets 17. Specifically, as illustrated in FIG. 2, multiple-ply sheets or integrated forms 18 tend to curl at the leading edges 28, particularly when the moisture content of the ambient air or the humidity changes. Curling can result from other environmental changes as well. The curled leading edges 28 illustrated in FIG. 2 will cause consistent jamming problems with most feeder mechanisms.

Jamming of the printers 10 causes down time, frustration, increased maintenance costs and therefore generally increases the costs associated with printing multiple-ply sheets 18 or integrated forms 18 using conventional printers like the one shown at 10 and FIG. 1.

Figure 3:
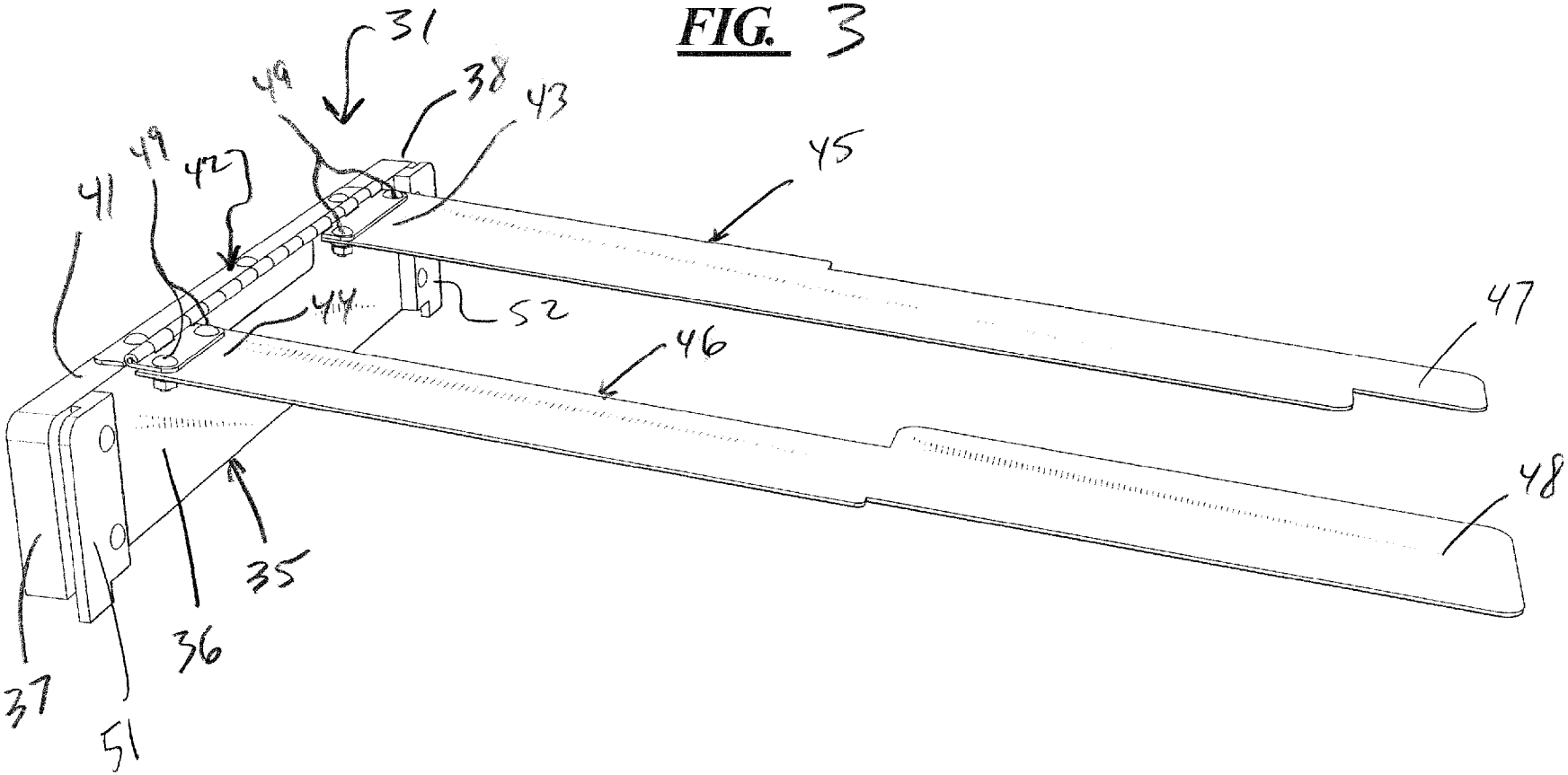
FIG. 3 is a perspective view of one disclosed hold-down device made in accordance with this disclosure.
Figure 6:
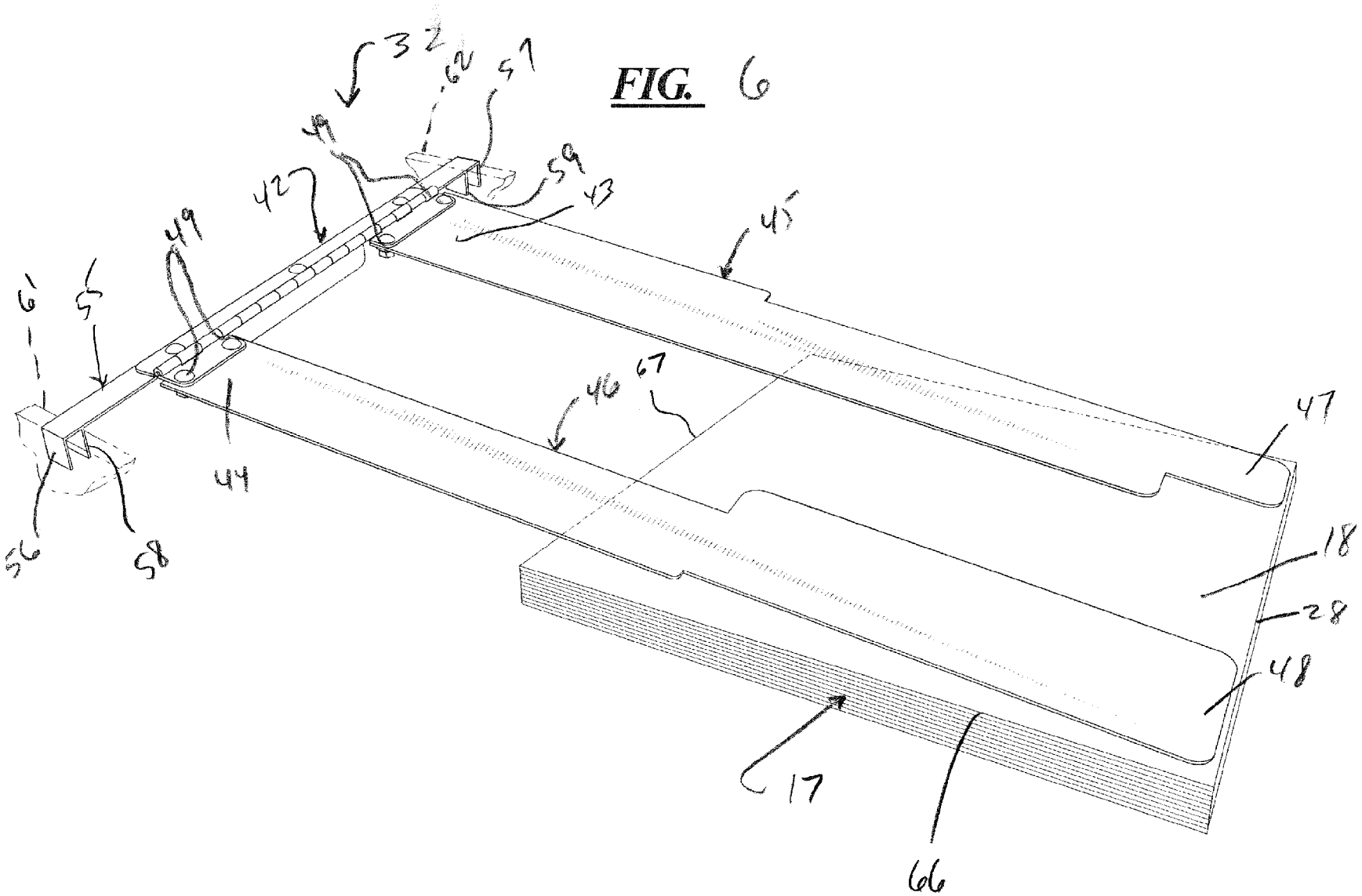
FIG. 6 is a perspective view of another disclosed hold-down device made in accordance with this disclosure with a rear strip equipped with retainers or clips for detachably connecting the hold-down device to the paper tray.
Figure 7:
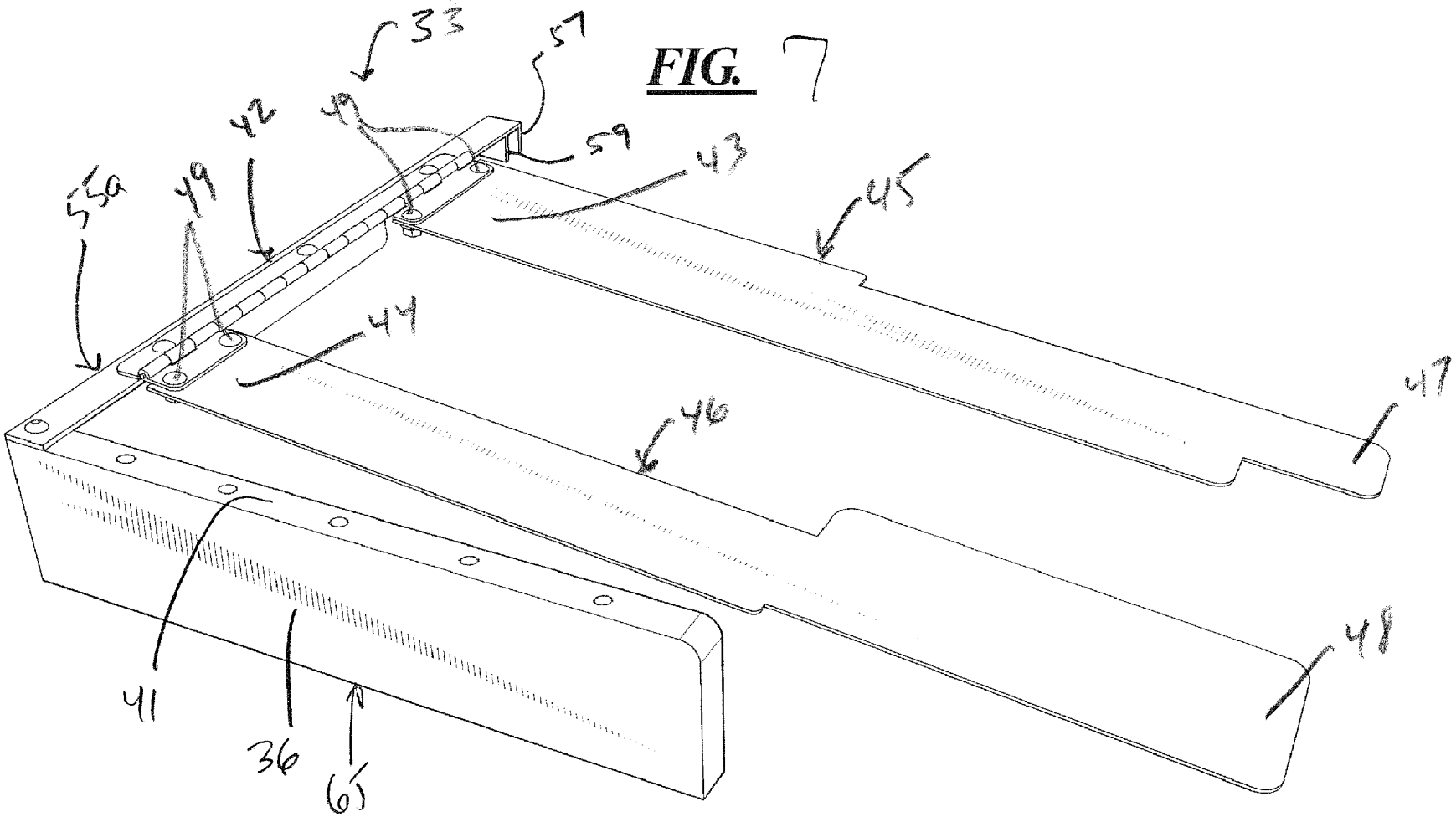
FIG. 7 is a perspective view of yet another disclosed hold-down device made in accordance with this disclosure with a base disposed along the side edges of the sheets and with a rear strip perpendicularly connected to the base and hingedly connected to a pair of arms and that further includes a retainer or clip for detachably connecting the hold-down device to the paper tray.

To alleviate this problem, hold-down devices 31, 32, and 33 are illustrated in FIGS. 3 and 6-7 respectively are disclosed herein. Turning first to FIG. 3, the hold-down device 31 includes a base 35 that includes a vertical wall 36 and two ends 37, 38. The wall 36 includes an upper edge 41 that is connected to a hinge 42. The hinge 42, in turn, is connected to the proximal ends 43, 44 of two arms 45, 46, both of which include distal ends 47, 48. The arms 45, 46 may be connected to a hinge 42 with one or more fasteners 49. Preferably, the fasteners 49 are detachable so that the arms 45, 46 may be changed for either shorter or longer arms, depending upon the tray assembly 16 and particular sheets 18 being printed. FIG. 3 also illustrates two retainers 51, 52 that can be used to detachably connect the base 35 to a paper tray assembly 16.

Figure 4:
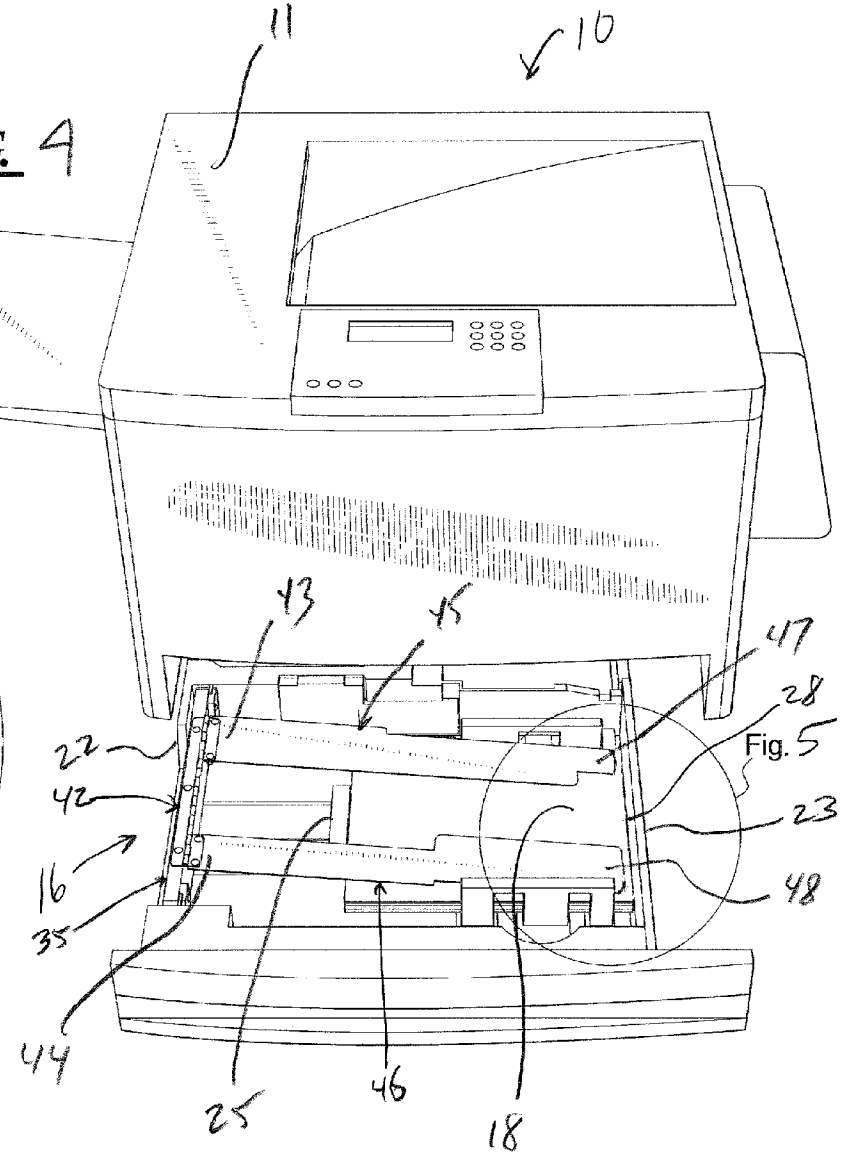
FIG. 4 is a perspective view of a printer and paper tray with the hold-down device of FIG. 3, installed in the paper tray of FIG. 1 and pressing the leading edges of the sheets into a flat or horizontal position.
Figure 5:
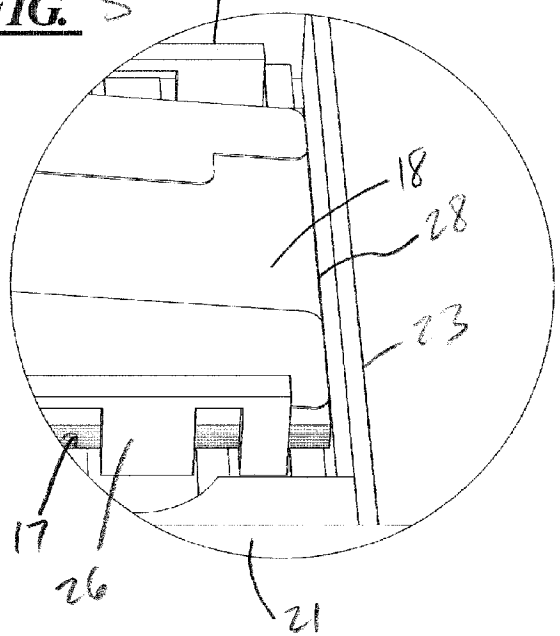
FIG. 5 is an enlarged partial view of the paper tray and hold-down device illustrated in FIG. 4.

FIGS. 4-5 illustrate the installation of the hold-down device 31 in the paper tray assembly 16 of the printer 10. The base 35 is disposed along the rear wall 22 and behind the rear brace 25. The arms 45, 46 extend toward the front wall 23. The distal ends 47, 48 of the arms 45, 46 rest on top of the leading edge of the top sheet 18 thereby suppressing or preventing any curling at the leading edge 28. The distal ends 47, 48 of the arms 45, 46 preferably rest adjacent to but proximally or short of the leading edge 28 of the top sheet 18 so the distal ends 47, 48 of the arms 45, 46 do not interfere with the printer feed mechanism. As shown in FIGS. 4-5, the top sheet 18 has a flat or horizontal leading edge 28 that can be reliably received in the feed mechanism of the printer 10.

Alternative designs are illustrated in FIGS. 6-7. Turning to FIG. 6, the hold-down device 32 includes a rear strip 55 with two ends 56, 57, each equipped with clips 58, 59 for detachably connecting the rear strip 55 to walls or other structures of a printer tray shown in phantom at 61, 62. A hinge 42 and arms 45, 46 are also shown. In FIG. 7, the hold-down device 33 includes a side base 65 that includes a vertical wall 36 with a top edge 41, but that is disposed parallel to the side edges 66 of the sheets 17 as opposed to the rear edges 67 of the sheets 17 (see FIG. 6). The base 65 is connected to a rear strip 55*a* with a free end 57 and retainer 59 and is connected to a hinge 42, similar to the hold-down devices 31 and 32 shown in FIGS. 3 and 6.

Figure 8:
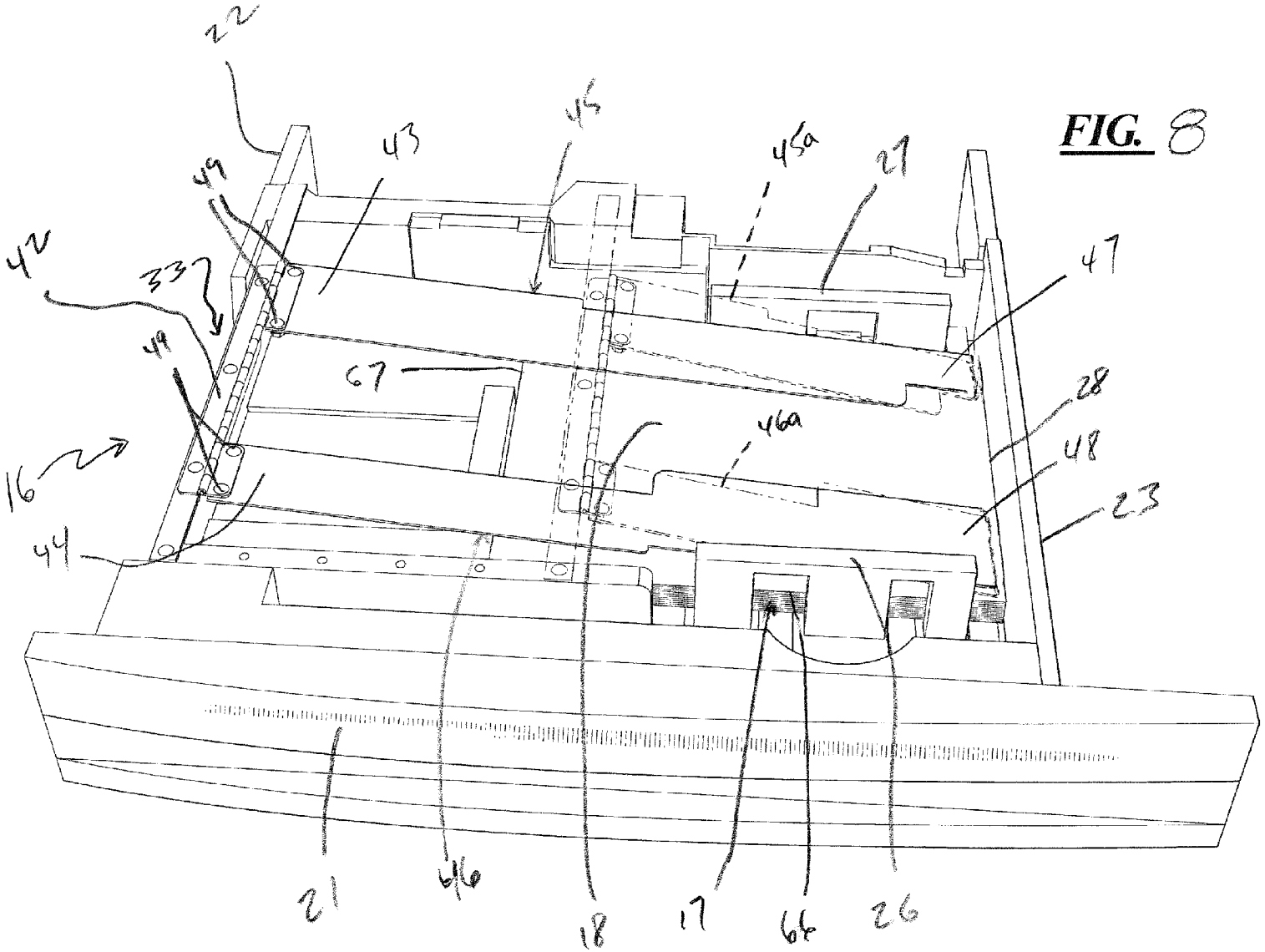
FIG. 8 is a perspective view of a paper tray and two hold-down devices of different arm lengths.

Finally, as shown in FIG. 8 it may be necessary to change the lengths of the arms 45, 46. Hence, the fasteners 49 are preferably of a form that can be easily removed such as the nut and bolt combination illustrated in FIGS. 3 and 6-8. Shorter arms are shown in phantom at 45*a*, 46*a* in FIG. 8.

The base structures 35, 65 and arms 45, 46, 45*a*, 46*a* can be molded from a suitable plastic or polymer materials. The elongated rear strips 55, 55*a* are preferably fabricated from metal due to their thin structure, but the plastic or polymer materials may be used for the rear strips 55, 55*a* as well in greater thicknesses or with fiber reinforcement elements. The hinges 42 are preferably fabricated from metal. However, living hinges connecting plastic arms 45, 46 to a plastic base structure 35 or plastic rear strips 55, 55*a* are possible and considered to be within the scope of this disclosure.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A device for holding leading edges of sheets disposed in a tray of a printer in a horizontal position prior to feeding a top sheet into the printer, each of the sheets also including rear edges and opposing side edges, the device comprising:

a base;

the base hingedly connected to at least one arm, the arm comprising a proximal end and a distal end, the base being detachably coupled to the tray;

the distal end of the arm engaging the top sheet adjacent, but proximal to the leading edge of the top sheet.

2. The device of claim 1 wherein the device comprises a pair of parallel arms hingedly connected to the base with distal ends each engaging the top sheet adjacent, but proximal to the leading edge of the top sheet.

3. The device of claim 1 wherein the base is disposed opposite the rear edges of the sheets from the leading edges of the sheets.

4. The device of claim 1 wherein the base further comprises at least one retainer for detachably connecting the base to the tray.

5. The device of claim 1 wherein the base comprises two ends, each end comprising a retainer for detachably connecting the base to the tray.

6. A device for holding leading edges of sheets disposed in a tray of a printer in a horizontal position prior to feeding a top sheet into the printer, each of the sheets also including rear edges and opposing side edges, the device comprising:

a base disposed parallel to one of the side edges of the sheets, the base being perpendicularly connected to a rear strip, the rear strip being hingedly connected to the at least one arm;

the arm comprising a proximal end and a distal end;

the distal end of the arm engaging the top sheet adjacent, but proximal to the leading edge of the top sheet.

7. The device of claim 6 wherein the device comprises a pair of parallel arms hingedly connected to the rear strip and with distal ends each engaging the top sheet adjacent, but proximal to the leading edge of the top sheet.

8. The device of claim 6 wherein the rear strip comprises at least one retainer for detachably connecting the base to the tray.

9. The device of claim 6 wherein the rear strip comprises two ends, each end comprising a retainer for detachably connecting the base to the tray.

10. A paper tray assembly for a printer, the paper tray assembly comprising:

a tray comprising a front wall, a rear wall and a pair of sidewalls extending therebetween, the tray further comprising a bottom for supporting a stack of sheets, each sheet comprising a leading edge disposed adjacent to the front wall of the tray, each sheet further comprising a rear edge and opposing side edges extending therebetween;

the assembly further comprising a hold-down device for holding the leading edges of the sheets disposed in the tray in a horizontal position prior to feeding a top sheet into the printer, the hold-down device comprising a base hingedly connected to at least one arm, the base of the hold-down device being detachably coupled to the tray, the arm comprising a proximal end and a distal end;

the distal end of the arm engaging the top sheet adjacent, but proximal to the leading edge of the top sheet.

11. The paper tray assembly of claim 10 wherein the hold-down device comprises a pair of parallel arms hingedly connected to the base with distal ends each engaging the top sheet adjacent, but proximal to the leading edge of the top sheet.

12. The paper tray assembly of claim 10 wherein the base of the hold-down device is disposed behind the rear edges of the sheets.

13. The paper tray assembly of claim 10 wherein the base of the hold-down device further comprises at least one retainer for detachably connecting the base to the tray.

14. The paper tray assembly of claim 10 wherein the base of the hold-down device comprises two ends, each end comprising a retainer for detachably connecting the base to the tray.

15. A paper tray assembly for a printer, the paper tray assembly comprising:

a tray comprising a front wall, a rear wall and a pair of sidewalls extending therebetween, the tray further comprising a bottom for supporting a stack of sheets, each sheet comprising a leading edge disposed adjacent to the front wall of the tray, each sheet further comprising a rear edge and opposing side edges extending therebetween;

the assembly further comprising a hold-down device for holding the leading edges of the sheets disposed in the tray in a horizontal position prior to feeding a top sheet into the printer, the hold-down device comprising a base hingedly connected to at least one arm, the base of the hold-down device is disposed parallel to one of the side edges of the sheets, the base of the hold-down device being perpendicularly connected to a rear strip, the rear strip being hingedly connected to the at least one arm, the arm comprising a proximal end and a distal end;

the distal end of the arm engaging the top sheet adjacent, but proximal to the leading edge of the top sheet.

16. The paper tray assembly of claim 15 wherein the hold-down device comprises a pair of parallel arms hingedly connected to the rear strip and with distal ends each engaging the top sheet adjacent, but proximal to the leading edge of the top sheet.

17. The paper tray assembly of claim 15 wherein the rear strip comprises at least one retainer for detachably connecting the base to the tray.

18. The paper tray assembly of claim 15 wherein the rear strip comprises two ends, each end comprising a retainer for detachably connecting the base to the tray.

19. A hold-down device for holding leading edges of sheets disposed in a tray of a printer in a horizontal position prior to feeding a top sheet into the printer, each of the sheets also including rear edges and opposing side edges, the device comprising:

a base comprising two ends, each end comprising a retainer for detachably connecting the base to the tray of the printer;

the base being hingedly connected to a pair of parallel arms, each arm comprising a proximal end and a distal end;

the distal end of each arm engaging the top sheet adjacent, but proximal to the leading edge of the top sheet.

20. The device of claim 19 wherein the pair of parallel arms is also detachably connected to the base and may be replaced with shorter or longer arms.

* * * * *